US006365313B1

(12) United States Patent
Masuo et al.

(10) Patent No.: US 6,365,313 B1
(45) Date of Patent: Apr. 2, 2002

(54) TONER FOR DEVELOPMENT OF ELECTROSTATIC IMAGE AND PRODUCTION PROCESS THEREOF

(75) Inventors: Kojiro Masuo; Takuji Kishimoto, both of Kanagawa (JP)

(73) Assignee: Nippon Zeon Co., Ltd., Tokyo (JP)

( * ) Notice: Subject to any disclaimer, the term of this patent is extended or adjusted under 35 U.S.C. 154(b) by 0 days.

(21) Appl. No.: 09/623,540

(22) PCT Filed: Mar. 19, 1999

(86) PCT No.: PCT/JP99/01396

§ 371 Date: Sep. 5, 2000

§ 102(e) Date: Sep. 5, 2000

(87) PCT Pub. No.: WO99/47982

PCT Pub. Date: Sep. 23, 1999

(30) Foreign Application Priority Data

Mar. 19, 1998 (JP) ..... 10-090752

(51) Int. Cl.[7] ..... G03G 9/097
(52) U.S. Cl. ..... 430/108.22; 430/137.17
(58) Field of Search ..... 430/110, 111, 430/137, 108.22, 137.17

(56) References Cited

U.S. PATENT DOCUMENTS 4,960,669 A * 10/1990 Mori et al. ..... 430/137
5,427,885 A * 6/1995 Ota et al. ..... 430/137
5,482,807 A * 1/1996 Aoki et al. ..... 430/110
5,753,396 A * 5/1998 Nakamura et al. ..... 430/111

FOREIGN PATENT DOCUMENTS

| | | |
|---|---|---|
| JP | 59-123852 | 7/1984 |
| JP | 3-015858 | 1/1991 |
| JP | 3-175456 | 7/1991 |
| JP | 9-034165 | 2/1997 |

* cited by examiner

*Primary Examiner*—Janis L. Dote
(74) *Attorney, Agent, or Firm*—Dinsmore & Shohl LLP

(57) ABSTRACT

A toner for development of electrostatic images, obtained by subjecting a polymerizable monomer composition containing at least a colorant, a polymerizable monomer and a charge control agent to suspension polymerization in an aqueous medium containing a dispersing agent, wherein (a) the dispersing agent is a cationic inorganic dispersing agent; and (b) the charge control agent is a quaternary ammonium salt group-containing copolymer comprising a vinyl aromatic hydrocarbon unit, a (meth)acrylate unit and a quaternary ammonium salt group-containing (meth) acrylate unit, having a weight average molecular weight of 25,000 to 40,000 in terms of polystyrene as measured by gel permeation chromatography using tetrahydrofuran and containing the quaternary ammonium salt group-containing (meth)acrylate unit in a proportion of 1 to 15 wt. %, and a production process thereof.

11 Claims, No Drawings

TONER FOR DEVELOPMENT OF ELECTROSTATIC IMAGE AND PRODUCTION PROCESS THEREOF

TECHNICAL FIELD

The present invention relates to a toner for development of electrostatic images, and more particularly to a toner for development of electrostatic images, which is excellent in stability to positive charging, flowability and shelf stability and moreover little in variation of charge level by changes in environments such as temperature and humidity or continuous printing, and can retain high image quality in monochromatic or color images, and a production process thereof.

BACKGROUND ART

In general, in an image forming apparatus such as an electrophotographic apparatus or electrostatic recording apparatus, an electrostatic latent image is formed on a photosensitive member uniformly and evenly charged by exposure to a light pattern, and a developer (toner) is applied to the electrostatic latent image to form a toner image (visible image). The toner image is transferred to a transfer medium such as paper or OHP film, and the unfixed toner image is then fixed to the transfer medium by a method such as heating, pressing or use of solvent vapor. In the fixing step, the toner is often fusion-bonded to the transfer medium by passing the transfer medium, to which the toner image has been transferred, through between a heating roll (fixing roll) and a press roll to press-bond the toner under heat.

Processes for producing a toner are roughly divided into a grinding process and a polymerization process. In recent years, polymerized toners easy to control their particle diameter without conducting complicated production steps such as classification have come to attract attention. According to the polymerization process, a polymerized toner having desired particle diameter and particle diameter distribution can be obtained without need of grinding and classification.

By the way, developers for making an electrostatic latent image on a photosensitive member visible by electrostatic attraction force include a negatively charged developer and a positively charged developer and are used properly depending on a development system or the kind of the photosensitive member. In order to control the charging properties of a developer, various kinds of charge control agents are generally used. A positive charge development system making use of a positively charged developer is preferred because it generally generates ozone in a smaller amount upon charging of a photosensitive member compared with a negative charge development system making use of a negatively charged developer, and is hence safe for users and gives them no unpleasant feeling. In addition, the positive charge development system is expected to permit the formation of images having high resolution by its combination with a polymerized toner having a small and even particle diameter.

As positively charged toners, there have heretofore been known those containing a Nigrosine dye as a charge control agent. However, the Nigrosine dye is black and adversely affects the coloring of color toners.

Japanese Patent Application Laid-Open No. 123852/1984 discloses a process for producing a toner, in which a monomer system containing a polymerizable monomer and a cationic polymer is suspended in a dispersion medium containing an anionic dispersing agent to polymerize it.

Although the polymerized toner obtained by this process is excellent in blocking resistance because the cationic polymer collects on the surface of the toner to form a shell, however, it has involved a drawback that sufficient charge capacity cannot be achieved when it is used in a non-magnetic one-component development system in which an electric charge is applied to a toner by triboelectrification through a sleeve or blade, so that fogging occurs.

Japanese Patent Application Laid-Open No. 15858/1991 discloses a polymerized toner obtained by subjecting a polymerizable monomer system containing at least a polar substance and a parting agent to suspension polymerization, in which a copolymer having a weight average molecular weight of 2,000 to 15,000 and composed of styrene and/or a-methylstyrene and 2-acrylamide-2-methylpropanesulfonic acid is used as the polar substance to provide the polymerized toner as a toner having stable charge property. However, the polymerized toner obtained by using the above-described copolymer as the polar substance has insufficient flowability, and so an image formed therefrom is blurred or deteriorated in image quality. The polymerized toner tends to undergo blocking and hence has poor shelf stability.

Japanese Patent Application Laid-Open No. 175456/1991 discloses a process for producing a toner for development of electrostatic images, in which a colorant is dispersed in a polymerizable monomer in the presence of a quaternary ammonium salt group-containing copolymer represented by a specific formula, and the resultant dispersion is subjected to suspension polymerization in a suspension medium containing an inorganic dispersing agent. This publication describes the fact that the weight average molecular weight of the quaternary ammonium salt group-containing copolymer is preferably within a range of 2,000 to 20,000. The publication also shows experimental examples where calcium tertiary phosphate was used as the inorganic dispersing agent to produce a polymerized toner. However, the polymerized toners obtained by using the quaternary ammonium salt group-containing copolymer are insufficient in flowability and shelf stability and moreover high in environmental dependence of image quality and also insufficient in durability of image quality.

As described above, it has been extremely difficult to obtain a polymerized toner which is excellent in stability to positive charging, environmental stability of charge level, flowability, shelf stability, etc., low in environmental dependence of image quality of images formed from such a toner, and suitable for use as a color toner.

DISCLOSURE OF THE INVENTION

It is an object of the present Invention to provide a toner for development of electrostatic images, which is excellent In stability to positive charging, flowability and shelf stability and moreover little in variation of charge level by changes in environments such as temperature and humidity or continuous printing, and can retain high image quality in monochromatic or color images, and a production process thereof.

Another object of the present invention is to provide a toner for development of electrostatic Images, which is excellent in stability of droplets of a polymerizable monomer composition In an aqueous medium upon polymerization, low in environmental dependence of image quality of images formed from such a toner and excellent in durability, and a production process thereof.

A further object of the present invention is to provide a toner for development of electrostatic images, which has the property of being positively charged and can be provided as a color toner, and a production process thereof.

The present inventors have carried out an extensive investigation with a view toward overcoming the above-described problems involved in the prior art. As a result, it has been found that in a process for producing a toner for development of electrostatic images by subjecting a polymerizable monomer composition containing at least a colorant, a polymerizable monomer and a charge control agent to suspension polymerization in an aqueous medium containing a dispersing agent, a cationic inorganic dispersing agent is used as the dispersing agent, and a specific quaternary ammonium salt group-containing copolymer is used as the charge control agent, thereby obtaining a polymerized toner excellent in such various properties as described above.

According to the present invention, there is thus provided a toner for development of electrostatic images, obtained by subjecting a polymerizable monomer composition containing at least a colorant, a polymerizable monomer and a charge control agent to suspension polymerization in an aqueous medium containing a dispersing agent, wherein (a) the dispersing agent is a cationic inorganic dispersing agent; and (b) the charge control agent is a quaternary ammonium salt group-containing copolymer comprising a vinyl aromatic hydrocarbon unit, a (meth)acrylate unit and a quaternary ammonium salt group-containing (meth) acrylate unit, having a weight average molecular weight of 25,000 to 40,000 in terms of polystyrene as measured by gel permeation chromatography using tetrahydrofuran and containing the quaternary ammonium salt group-containing (meth)acrylate unit in a proportion of 1 to 15 wt. %.

According to the present invention, there is also provided a process for producing a toner for development of electrostatic images by subjecting a polymerizable monomer composition containing at least a colorant, a polymerizable monomer and a charge control agent to suspension polymerization in an aqueous medium containing a dispersing agent, the process comprising (1) using, as the charge control agent, a cationic inorganic dispersing agent; and (2) using, as the charge control agent, a quaternary ammonium salt group-containing copolymer comprising a vinyl aromatic hydrocarbon unit, a (meth)acrylate unit and a quaternary ammonium salt group-containing (meth)acrylate unit, having a weight average molecular weight of 25,000 to 40,000 in terms of polystyrene as measured by gel permeation chromatography using tetrahydrofuran and containing the quaternary ammonium salt group-containing (meth)acrylate unit in a proportion of 1 to 15 wt. %.

BEST MODE FOR CARRYING OUT THE INVENTION

1. Quaternary Ammonium Salt Group-containing Copolymer:

In the present invention, a specific quaternary ammonium salt group-containing copolymer is used for imparting the property of being positively charged to a toner for development of electrostatic images. The quaternary ammonium salt group-containing copolymer is a copolymer comprising a vinyl aromatic hydrocarbon unit, a (meth)acrylate unit and a quaternary ammonium salt group-containing (meth) acrylate unit, having a weight average molecular weight of 25,000 to 40,000 in terms of polystyrene as measured by gel permeation chromatography using tetrahydrofuran and containing the quaternary ammonium salt group-containing (meth)acrylate unit in a proportion of 1 to 15 wt. %.

(1) Vinyl Aromatic Hydrocarbon Unit:

The vinyl aromatic hydrocarbon unit in the quaternary ammonium salt group-containing copolymer used in the present invention can be introduced into the copolymer by copolymerizing a vinyl aromatic hydrocarbon monomer with any other monomer.

Examples of the vinyl aromatic hydrocarbon include styrene, α-methylstyrene, 3-methylstyrene, 4-methylstyrene, 2-ethylstyrene, 4-ethylstyrene, 3-propylstyrene, 4-propyl-styrene, 2-isopropylstyrene, 2-chlorostyrene, 4-chlorostyrene, 2-methyl-a-methylstyrene, 4-methyl-α-methylstyrene, 3-ethyl-a-methylstyrene, 4- ethyl-α-methylstyrene, 2-propyl-α-methylstyrene, 4-propyl-α-methylstyrene, 2-isopropyl-α-methylstyrene, 4-isopropyl-α-methylstyrene, 3-chloro-α-methylstyrene, 4-chloro-α-methylstyrene, 3,4-dimethylstyrene, 2,4-dimethylstyrene, 2,6-dimethylstyrene, 2,3-diethylstyrene, 2,4-diethyl-styrene, 2-methyl-3-ethylstyrene, 2-methyl-4-ethylstyrene, 2,3-dimethyl-α-methylstyrene, 2,4-dimethylstyrene, 2,6-dimethyl-α-methylstyrene, 3,4-diethyl-α-methylstyrene, 2,6-diethyl-α-methylstyrene, 2-ethyl-3-methyl-α-methylstyrene, 2-methyl-4-propyl-α-methylstyrene and 2-chloro-4-ethyl-α-methylstyrene. These vinyl aromatic hydrocarbon monomers may be used either singly or in any combination thereof.

(2) (Meth)acrylate Unit:

The (meth)acrylate unit in the quaternary ammonium salt group-containing copolymer used in the present invention can be introduced into the copolymer by copolymerizing a (meth)acrylate monomer.

Examples of the (meth)acrylate monomer include acrylates such as methyl acrylate, ethyl acrylate, propyl acrylate, isopropyl acrylate, n-butyl acrylate, isobutyl acrylate, n-amyl acrylate, isoamyl acrylate, n-hexyl acrylate, 2-ethylhexyl acrylate, hydroxypropyl acrylate and lauryl acrylate; and methacrylates such as methyl methacrylate, ethyl methacrylate, propyl methacrylate, isopropyl methacrylate, n-butyl methacrylate, isobutyl methacrylate, n-amyl methacrylate, isoamyl methacrylate, n-hexyl methacrylate, 2-ethylhexyl methacrylate, hydroxypropyl methacrylate and lauryl methacrylate. These (meth)acrylate monomers may be used either singly or in any combination thereof.

(3) Quaternary Ammonium Salt Group-containing (Meth) acrylate Unit:

The quaternary ammonium salt group-containing (meth) acrylate unit in the quaternary ammonium salt group-containing copolymer used in the present invention is a repeating unit represented by the formula (A):

(A)

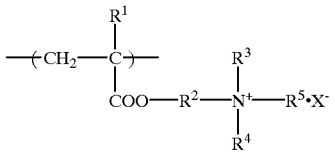

wherein $R^1$ is a hydrogen atom or a methyl group, $R^2$ is a group represented by the following formula (a1), $R^3$ to $R^5$ are independently a hydrogen atom or a linear, branched or cyclic alkyl group having 1 to 6 carbon atoms, and X is a halogen atom or an atomic group represented by the following formula (a2).

Formula (a1)

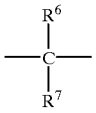

(a1)

wherein $R^6$ and $R^7$ are independently a hydrogen or halogen atom, or a linear or branched alkyl group having 1 to 3 carbon atoms. Formula (a2):

$$R^8—A—M \quad (a2)$$

wherein $R^8$ is a hydrogen atom, a linear, branched or cyclic alkyl group having 1 to 6 carbon atoms, or a halogen atom, A is a phenylene group which may have a hydrogen atom, a linear, branched or cyclic alkylene group having 1 to 6 carbon atoms, a linear, branched or cyclic alkyl group having 1 to 6 carbon atoms, or a halogen atom, and M is $SO_3^-$, $PO_3^-$ or $BO_3^-$.

In the formula (A), $R^3$ and $R^4$ are preferably independently a hydrogen atom, or a linear or branched alkyl group having 1 to 3 carbon atoms. $R^5$ is preferably a linear alkyl group having 1 to 3 carbon atoms. X is preferably a halogen atom or an atomic group represented by the following formula (a3):

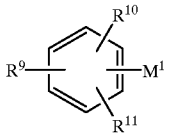

(a3)

wherein $R^9$ to $R^{11}$ are independently a hydrogen atom, a linear, branched or cyclic alkyl group having 1 to 6 carbon atoms, or a halogen atom, and $M^1$ is $SO_3^-$.

Examples of a method for introducing the quaternary ammonium salt group-containing (meth)acrylate unit into the copolymer include the following methods:

(i) A method in which a vinyl aromatic hydrocarbon monomer, a (meth)acrylate monomer and an N,N-disubstituted aminoalkyl (meth)acrylate monomer are copolymerized in the presence of a polymerization initiator, and amino groups in the resulting terpolymer are quaternized with a quaternizing agent such as a halogenated organic compound or acid ester compound;

(ii) a method in which a vinyl aromatic hydrocarbon monomer, a (meth)acrylate monomer and a monomer (hereinafter referred to as "halogenated quaternary ammonium salt group-containing (meth)acrylate monomer") obtained by forming an N,N-disubstituted aminoalkyl (meth)acrylate monomer into a quaternary ammonium salt group with a halogenated organic compound are copolymerized in the presence of a polymerization initiator, and the resultant terpolymer is reacted with an organic acid or a derivative thereof to form a salt (Japanese Patent Application Laid-Open No. 175456/1991); and (iii) a method in which a vinyl aromatic hydrocarbon monomer, a (meth)acrylate monomer and a quaternary ammonium salt group-containing (meth)acrylate monomer are copolymerized in the presence of a polymerization initiator.

When X in the quaternary ammonium salt group-containing (meth)acrylate monomer unit represented by the formula (A) is a halogen, there is no need for the reaction with the organic acid or the derivative thereof in the method (ii). Besides the method of preparing the monomer [halogenated quaternary ammonium salt group-containing (meth)acrylate monomer] obtained by forming the N,N-disubstituted aminoalkyl (meth)acrylate monomer into the quaternary ammonium salt group with the halogenated organic compound in accordance with the method (ii), a commercially-available halogenated quaternary ammonium salt group-containing (meth)acrylate compound, for example, N,N,N-trimethyl-N-(2-methacryloxyethyl) ammonium chloride (DMC), N-benzyl-N,N-dimethyl-N-(2-methacryloxy-ethyl)ammonium chloride (DML) or the like, may be used. Commercially-available compounds obtained by sulfonating these compounds, such as the sulfates, dimethylsulfates, diethylsulfates and p-toluenesulfonates may also be used to omit the esterification with the organic acid or the derivative thereof.

(4) Polymerization Initiator:

As examples of a polymerization initiator used in the preparation of the quaternary ammonium salt group-containing copolymer by the above-described method, may be mentioned azo compounds such as 2,2'-azobisisobutyronitrile, 2,2'-azobis(2,4-dimethylvaleronitrile), 2,2'-azobis(4-methoxy-2,4-dimethylvaleronitrile), 2,2'-azobisisobutyrate and 4,4'-azobis(4-cyanopentanoic acid); diamine compounds such as 2,2'-azobis(2-aminodipropane) dihydrochloride, 2,2'-azobis (N,N'-dimethyleneisobutylamidine) and 2,2'-azobis-(N,N'-dimethyleneisobutylamidine) dihydrochloride; persulfates such as potassium persulfate and ammonium persulfate; and peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, di-isopropyl peroxydicarbonate and di-t-butyl peroxyisophthalate. Redox initiators composed of combinations of these polymerization initiators with a reducing agent may also be used.

The amount of the polymerization initiator used can be optionally selected according to the intended weight average molecular weight of the copolymer. Specifically, the amount of the polymerization initiator used is generally 0.01 to 10 parts by weight, preferably 0.1 to 5 parts by weight per 100 parts by weight of the total weight of the monomers used. If the amount of the polymerization initiator used is less than 0.01 wt. % based on the aqueous medium, the rate of polymerization becomes slow. If the amount exceeds 10 wt. %, the molecular weight of the resulting copolymer becomes low, and so the resulting toner tends to deteriorate its shelf stability. Further, solution polymerization with an initiator for anionic polymerization, such as an alkali metal, butyllithium, a reaction product of an alkali metal and naphthalene, or the like is preferred because the molecular weight of the resulting copolymer can be easily controlled.

(5) Polymerization Process:

As a polymerization process for conducting copolymerization according to the above-described method, may be used any process of emulsion polymerization, dispersion polymerization, suspension polymerization, solution polymerization, etc. However, the solution polymerization is particularly preferred in that the intended weight average molecular weight is easy to achieve.

Examples of a solvent or dispersing agent used in each polymerization process include aliphatic or aromatic hydrocarbon compounds; nitrogen-containing organic compounds such as nitriles, amines, amides and heterocyclic compounds; oxygen-containing organic compounds such as alcohols, ketones, carboxylic acid esters, ethers and carboxylic acids; chlorine-containing organic compounds such as chlorine-substituted products of aliphatic hydrocarbons; and sulfur-containing organic compounds. One or more solvents or dispersing agents may be suitably selected from these compounds.

Polymerization temperature and polymerization time may be optionally selected according to the kinds of polymerization process and polymerization initiator used, and the like. However, the polymerization temperature is generally about 50 to 200° C., and the polymerization time is generally about 0.5 to 20 hours. Upon polymerization, conventionally known various additives, for example, a polymerization aid such as an amine, may also be used in combination. As a method for collecting a copolymer from the reaction system after polymerization, there is used a method in which a poor solvent is added to the reaction system to precipitate the copolymer, a method in which the solvent is removed by steam, a method in which the solvent is removed under reduced pressure, etc. There is also used a method in which the polymerization is conducted at a high concentration, and the reaction mixture is used in the polymerization system of a toner as it is.

(6) Weight Average Molecular Weight:

The weight average molecular weight (Mw) of the quaternary ammonium salt group-containing copolymer is 25,000 to 40,000, preferably 26,000 to 40,000, more preferably 26,000 to 39,000. If the weight average molecular weight of the quaternary ammonium salt group-containing copolymer is too high, the charge level distribution of the resulting polymerized toner becomes wide, and charging is lowered at high temperature and high humidity, resulting in easy occurrence of fogging. If the weight average molecular weight is too low on the other hand, the flowability of the resulting polymerized toner becomes insufficient, and its shelf stability is also deteriorated. The Mw is a value in terms of polystyrene as measured by gel permeation chromatography (GPC) using tetrahydrofuran.

(7) Proportion of Quaternary Ammonium Salt Group-containing (Meth)acrylate Unit:

A proportion of the quaternary ammonium salt group-containing (meth)acrylate unit (hereinafter may be referred to "functional-group proportion" merely) in the quaternary ammonium salt group-containing copolymer used in the present invention is 1 to 15 wt. %, preferably 3 to 13 wt. %. If the proportion of the quaternary ammonium salt group-containing (meth)acrylate unit is too high, droplets of a mixture of the resulting quaternary ammonium salt group-containing copolymer and a polymerizable monomer in an aqueous medium becomes unstable even when the mixture is formed into the droplets in the aqueous medium, since the droplets have high hydrophilicity. As a result, the particle diameter distribution of the resulting polymerized toner becomes wide, and so classification is required to provide it as a final product, and the yield of the polymerized toner is hence lowered.

The compatibility of the quaternary ammonium salt group-containing copolymer with the polymer component of the polymerized toner can be enhanced by introducing the vinyl aromatic hydrocarbon unit and the (meth)acrylate unit into the quaternary ammonium salt group-containing copolymer. The glass transition temperature of the quaternary ammonium salt group-containing copolymer can be controlled within the desired range by adjusting proportions of these both units. This control has such merits that the fixing temperature of the resulting polymerized toner can be lowered without impairing the shelf stability thereof. A weight ratio of the vinyl aromatic hydrocarbon unit to the (meth)acrylate unit is generally 99:1 to 50:50, preferably 98:2 to 30:70.

Proportions of the respective repeating units (structural units) can be optionally preset by adjusting proportions of the respective monomers charged.

Supposing that the weight average molecular weight of the quaternary ammonium salt group-containing copolymer, the wt. % of the quaternary ammonium salt group-containing (meth)acrylate in the quaternary ammonium salt group-containing copolymer, and the proportion (parts by weight per 100 parts of the polymerizable monomer) of the quaternary ammonium salt group-containing copolymer used are A, B and C, respectively, an excellent toner, in particularly, excellent in stability to positive charging and little in the deterioration of image quality due to variations of charge level upon durable printing is easy to provide when a relationship among these satisfies generally $2{,}500 \leqq A \times B \times C \leqq 1{,}800{,}000$, preferably $5{,}000 \leqq A \times B \times C \leqq 1{,}600{,}000$, more preferably $10{,}000 \leqq A \times B \times C \leqq 1{,}400{,}000$.

(8) Proportion of Quaternary Ammonium Salt Group-containing Copolymer Blended:

In order to contain the quaternary ammonium salt group-containing copolymer as a charge control agent in a polymerized toner, it is only necessary to contain it in a polymerizable monomer composition upon preparation of a polymerized toner by suspension polymerization. The quaternary ammonium salt group-containing copolymer is added in a proportion of preferably 0.1 to 5 parts by weight, more preferably 0.3 to 3 parts by weight per 100 parts by weight of the polymerizable monomer. If this proportion is too low, it is difficult to sufficiently impart the property of being positively charged to the toner. If the proportion is too high, the stability of droplets of the polymerizable monomer composition is lowered upon formation thereof. It is hence not preferable to use the quaternary ammonium salt group-containing copolymer in such a low or high proportion.

2. Production Process of Toner for Development of Electrostatic Images:

The toner for development of electrostatic images according to the present invention can be produced by subjecting a polymerizable monomer composition containing at least a colorant, a polymerizable monomer and the quaternary ammonium salt group-containing copolymer as a charge control agent to suspension polymerization in an aqueous medium containing a cationic inorganic dispersing agent.

(1) Polymerizable Monomer:

In the present invention, a monovinyl monomer is generally used as the polymerizable monomer. Specific examples thereof include styrenic monomers such as styrene, vinyltoluene and a-methylstyrene; acrylic acid and methacrylic acid; derivatives of acrylic acid or methacrylic acid, such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These monovinyl monomers may be used either singly or in any combination thereof. Among these monovinyl monomers, the styrenic monomers and the derivatives of acrylic acid or methacrylic acid are preferably used.

(2) Crosslinkable Monomer:

It is preferred from the viewpoints of the shelf stability and hot offset resistance of the resulting polymerized toner to use a crosslinkable monomer in combination with the vinyl monomer. The crosslinkable monomer is a monomer having two or more polymerizable carbon-carbon unsaturated double bonds. As examples of the crosslinkable monomer, may be mentioned aromatic divinyl compounds such as divinylbenzene, divinylnaphthalene and derivatives thereof; di-ethylenically unsaturated carboxylic acid esters such as ethylene glycol dimethacrylate and diethylene glycol dimethacrylate; divinyl compounds such as N,N-divinylaniline and divinyl ether; and compounds having three or more vinyl groups. These crosslinkable monomers may be used either singly or in any combination thereof. In the present invention, it is desirable to use the crosslinkable monomer in a proportion of generally 0.01 to 5 parts by weight, preferably 0.1 to 2 parts by weight per 100 parts by weight of the polymerizable monomer (3) Macromonomer:

In the present invention, it is preferred from the viewpoints of improving a balance between low-temperature fixing ability and shelf stability to use a macromonomer together with the polymerizable monomer. The macromonomer (also referred to as a macromer) used in the present invention is a relatively long-chain linear molecule having a polymerizable functional group (for example, a group containing an unsaturated bond such as a carbon-carbon double bond) at its molecular chain terminal. The macromonomer is preferably an oligomer or polymer having a polymerizable vinyl functional group at its molecular chain terminal and a number average molecular weight of generally 1,000 to 30,000.

Examples of the polymerizable vinyl functional group bonded to the molecular chain terminal of the macromonomer include an acryloyl group and a methacryloyl group, with the methacryloyl group being preferred from the viewpoint of easy copolymerization.

The macromonomer used in the present invention preferably has a glass transition temperature (Tg) higher than that of a polymer obtained by polymerizing the polymerizable monomer. In the present invention, Tg is a value measured by means of an ordinary measuring device such as a differential scanning calorimeter (DSC).

As examples of the macromonomer, may be mentioned polymers obtained by polymerizing styrene, styrene derivatives, methacrylic esters, acrylic esters, acrylonitrile and methacrylonitrile either singly or in combination of two or more monomers thereof; macromonomers having a polysiloxane skeleton; and those disclosed in Japanese Patent Application Laid-Open No. 203746/1991, pages 4 to 7. Among these macromonomers, hydrophilic macromonomers, in particular, polymers obtained by polymerizing methacrylic esters or acrylic esters either singly or in combination of two or more monomers thereof are particularly preferred.

The proportion of the macromonomer is generally 0.01 to 10 parts by weight, preferably 0.03 to 5 parts by weight, more preferably 0.05 to 1 part by weight per 100 parts by weight of the polymerizable monomer.

(4) Colorant:

No particular limitation is imposed on the colorant for the toners according to the present invention, and proper pigments or dyes known to be employed in this use may be optionally used. As specific examples thereof, may be mentioned titanium dioxide, zinc white, alumina white, calcium carbonate, ultramarine blue, carbon black, Phthalocyanine Blue, Phthalocyanine Green, Hansa Yellow G, dodamine dyes and pigments, chrome yellow, quinacridone, benzidine yellow, rose bengal, triallylmethane dyes, anthraquinone dyes, monoazo and disazo dyes and pigments and magnetic particles.

In the present invention, a black colorant such as carbon black may be used as the colorant. Any other color colorant than the black colorant, for example, a yellow colorant, magenta colorant, cyan colorant or the like, may be suitably used. Examples of the yellow colorant include nitro pigments such as Naphthol Yellow S; azo pigments such as Hansa Yellow G, Benzidine Yellow GR, Vulcan Fast Yellow 56 and C.I. Pigment Yellow 180; inorganic pigments such as yellow iron oxide loess; and oil-soluble dyes such as C.I. Solvent Yellow 2. Examples of the magenta colorant include quinacridone pigments such as C.I. Pigment Red 122; Rhodamine pigments such as Rhodamine B; thioindigo pigments such as C.I. Pigment Red 87; azo pigments such as Brilliant Carmine 6B; and oil-soluble dyes such as C.I. Solvent Red 49. Examples of the cyan colorant include phthalocyanine pigments such as Pigment Blue 15:3 and Phthalocyanine Blue; and oil-soluble dyes such as C.I. Solvent Blue 25.

These colorants may be used either singly or in any combination thereof. Among these colorants, the dyes and pigments are used in a proportion of generally 0.1 to 20 parts by weight, preferably 0.5 to 10 parts by weight per 100 parts by weight of the polymerizable monomer. The magnetic particles are used in a proportion of generally 1 to 100 parts by weight, preferably 5 to 50 parts by weight per 100 parts by weight of the polymerizable monomer.

(5) Cationic Inorganic Dispersing Agent:

The dispersing agent used in the present invention is a cationic inorganic dispersing agent. This dispersing agent is used to conduct the suspension polymerization of the polymerizable monomer composition containing the quaternary ammonium salt group-containing copolymer, whereby a polymerized toner of an even particle form, which can provide high-quality images having excellent durability, can be obtained.

As specific examples of the cationic inorganic dispersing agent used in the present invention, may be mentioned metal hydroxides such as aluminum hydroxide, magnesium hydroxide and ferric hydroxide. In the present invention, colloid of a hardly water-soluble metal hydroxide is preferably used as the cationic inorganic dispersing agent. As examples of the hardly water-soluble metal hydroxide, may be mentioned the above-mentioned metal hydroxides such as aluminum hydroxide, magnesium hydroxide and ferric hydroxide. The use of the colloid of the hardly water-soluble metal hydroxide is preferred because it can narrow the particle diameter distributions of the resulting polymer particles can be narrowed, and the brightness or sharpness of an image formed from such a polymerized toner is enhanced.

The colloids of the hardly water-soluble metal hydroxides are not limited by the production process thereof. However, it is preferred to use colloid of a hardly water-soluble metal hydroxide obtained by adjusting the pH of an aqueous solution of a water-soluble polyvalent metallic compound to 7 or higher, in particular, colloid of a hardly water-soluble metal hydroxide formed by reacting a water-soluble polyvalent metallic compound with an alkali metal hydroxide in an aqueous phase. The colloid of the hardly water-soluble metallic compound preferably has number particle diameter distributions, $D_{50}$ (50% cumulative value of number particle diameter distribution) of at most 0.5 $\mu$m and $D_{90}$ (90% cumulative value of number particle diameter distribution) of at most 1 $\mu$m. If the particle diameter of the colloid is too great, the stability of the polymerization is broken, and the shelf stability of the resulting polymerized toner is deteriorated.

The cationic inorganic dispersing agent is used in a proportion of generally 0.1 to 20 parts by weight per 100 parts by weight of the polymerizable monomer. If this proportion is lower than 0.1 parts by weight, it is difficult to achieve sufficient dispersion stability upon the polymerization, so that polymer aggregates are liable to form. If the proportion exceeds 20 parts by weight on the other hand, the viscosity of the aqueous dispersion medium is increased, and the particle diameter distribution of the resulting polymerized toner becomes wide. It is hence not preferable to use the dispersing agent in such a too low or high proportion.

(6) Radical Polymerization Initiator:

In the present invention, a radical polymerization initiator is generally used for polymerizing the polymerizable monomer. The radical polymerization initiator is used by adding it to the polymerizable monomer composition or pouring it into the aqueous dispersion medium.

As the radical polymerization initiator, may be used the same initiator as that used in the preparation of the quaternary ammonium salt group-containing copolymer.

Among these radical polymerization initiators, oil-soluble radical initiators are preferred, with oil-soluble radical initiators selected from among organic peroxides whose decomposition temperature giving a half-life period of 10 hours are 60 to 80° C., preferably 65 to 80° C. and whose molecular weights are 250 or lower being particularly preferred. Among the oil-soluble radical initiators, t-butyl peroxy-2-ethylhexanoate is particularly preferred because the resulting polymerized toner scarcely gives odor upon printing and barely causes environmental destruction by volatile components such as odor.

The amount of the polymerization initiator used is generally 0.001 to 3 wt. % based on the aqueous medium. If the amount of the polymerization initiator used is lower than 0.001 wt. %, the rate of polymerization becomes slow. Any amount exceeding 3 wt. % results in a polymer having a low weight average molecular weight. It is hence not preferred to use the polymerization initiator in such a little or great amount.

(7) Molecular Weight Modifier:

In the present invention, a molecular weight modifier may be used. As examples of the molecular weight modifier, may be mentioned mercaptans such as t-dodecyl-mercaptan, n-dodecylmercaptan and n-octylmercaptan; and halogenated hydrocarbons such as carbon tetrachloride and carbon tetrabromide. These molecular weight modifiers may be added before the initiation of the polymerization or in the course of the polymerization. The molecular weight modifier is used in a proportion of generally 0.01 to 10 parts by weight, preferably 0.1 to 5 parts by weight per 100 parts by weight of the polymerizable monomer.

(8) Parting Agent:

In the present invention, a parting agent may be contained in the polymerizable monomer composition. As specific examples of the parting agent, may be mentioned low molecular weight polyolefin waxes such as low molecular weight polyethylene, low molecular weight polypropylene and low molecular weight polybutylene; terminal-modified polyolefin waxes such as low-molecular weight polypropylene oxidized at its molecular chain terminal, low-molecular weight terminal-modified polypropylene substituted at its molecular chain terminal by an epoxy group and block copolymers of these low-molecular weight polypropylenes with low-molecular weight polyethylene, low-molecular weight polyethylene oxidized at its molecular chain terminal, and low-molecular weight terminal-modified polyethylene substituted at its molecular chain terminal by an epoxy group and block copolymers of these low-molecular weight polyethylenes with low-molecular weight polypropylene; natural plant waxes such as candelilla, carnauba, rice, Japan wax and jojoba; petroleum waxes such as paraffin, microcrystalline and petrolatum, and modified waxes thereof; mineral waxes such as montan, ceresin and ozokerite; synthetic waxes such as Fischer-Tropsch wax; and polyfunctional ester compounds such as pentaerythritol tetrastearate, pentaerythritol tetramyristate and pentaerythritol tetrapalmitate. These parting agents may be used either singly or in any combination thereof. Among these, synthetic waxes (particularly, Fischer-Tropsch wax), polypropylene waxes, low-molecular weight polypropylene wax and microcrystalline wax are preferred.

The parting agent is used in a proportion of generally 0.1 to 40 parts by weight, preferably 1 to 20 parts by weight per 100 parts by weight of the polymerizable monomer. If the amount of the parting agent used is too small, the effect of improving the low-temperature fixing ability becomes little. If the amount is too great, the shelf stability and flowability of the resulting polymerized toner are deteriorated.

(9) Other Additives:

In the present invention, a lubricant such as oleic acid or stearic acid; a dispersion aid such as a silane or titanium coupling agent; and/or the like may be used for the purpose of, for example, improving the uniformly dispersing ability of the colorant. Such a lubricant or dispersion aid is generally used in a proportion of about 1/1,000 to 1/1 based on the weight of the colorant.

(10) Suspension Polymerization:

Suspension polymerization is conducted in an aqueous medium containing the cationic inorganic dispersing agent. Specifically, the colorant, polymerizable monomer, quaternary ammonium salt group-containing copolymer, and optionally selected macromonomer, crosslinkable monomer, radical polymerization initiator and other additives are first mixed, and the resultant mixture is uniformly dispersed in a ball mill or the like to prepare a liquid mixture (hereinafter may be referred to as "polymerizable monomer composition" or "liquid stock"). The liquid stock is then poured into the aqueous medium containing the cationic inorganic dispersing agent and dispersed therein by means of a mixer having high shearing force, thereby forming fine droplets of the polymerizable monomer composition. Thereafter, the suspension polymerization is conducted at a temperature of generally 30 to 200° C. As the mixer having high shearing force, a mixing device equipped with a rotor which rotates on its axis at high speed, and a stator surrounding it and having small openings or comb-like teeth is used, and the aqueous dispersion medium containing the liquid stock is passed through between the rotor and the stator, whereby the liquid stock is formed into the fine droplets (oil droplets).

When the radical polymerization initiator is not contained in the liquid stock in advance, the radical polymerization initiator is poured with stirring after the liquid stock is poured into the aqueous medium containing the dispersing agent and before the formation of the fine droplets is completed, whereby the radical polymerization initiator can be contained in the liquid stock in the aqueous medium.

The temperature of the aqueous medium from the addition of the radical polymerization initiator to the subsequent droplet-forming step is regulated within a range of generally 10 to 40° C., preferably 20 to 30° C. If this temperature is too high, a premature polymerization reaction partially occurs in the aqueous medium. If this temperature is too low on the other hand, the flowability of the aqueous medium containing the liquid stock is lowered to cause a possibility of interfering with the formation of the fine droplets by stirring.

If the droplet diameter of the droplets of the polymerizable monomer composition is too great, the particle diameter of the polymerized toner becomes too great, so that the resolution of images formed from such a toner is deteriorated. If the droplet diameter distribution of the droplets is wide, the fixing temperature of the resulting toner varies, so that inconveniences such as fogging and filming tend to occur.

In the production process according to the present invention, the suspension polymerization is conducted until the conversion of the polymerizable monomer into the polymer reaches generally at least 80%, preferably at least 85%, more preferably at least 90%. In general, the conversion into the polymer is preferably higher, and the polymerization reaction is continued until the conversion reaches often at least 98%, particularly preferably almost 100%. If the conversion into the polymer is too low, the remaining unreacted polymerizable monomer volatilizes when the resulting toner is heated and fixed, thereby worsening environment about the image forming apparatus used. In addition, if the conversion into the polymer is too low, the quantitative ratio of the quaternary ammonium salt group-containing copolymer to the polymer component forming the polymerized toner may possibly departs from the preferable range. When the conversion into the polymer is required to be lowered, however, the amount of the quaternary ammonium salt group-containing copolymer added is controlled so as to fall within a range of preferably 0.1 to 5 parts by weight, more preferably 0.3 to 3 parts by weight per 100 parts by weight of the polymerizable monomer actually participating in the polymerization reaction.

In the production process according to the present invention, it is preferred that the polymerizable monomer composition be added to the aqueous medium in a vessel for preparing a dispersion to form droplets thereof, thereby preparing a dispersion containing fine droplets of the polymerizable monomer composition, and the dispersion be then transferred to another vessel (vessel for polymerization reaction) to conduct the polymerization in this vessel. A process comprising preparing a dispersion in a polymerization reactor and conducting a polymerization reaction as it is like the conventional suspension polymerization process tends to generate scale in the polymerization reactor and form coarse particles of a toner in plenty.

In the present invention, a shell may be formed on each of colored polymer particles obtained by the above-described polymerization to provide a polymerized toner of a core-shell structure for the purpose of improving the shelf stability (blocking resistance), low-temperature fixing ability, melt property upon fixing and the like of the polymerized toner. In order to form the shell, the colored polymer particles are used as core particles to polymerize a polymerizable monomer for shell in the presence of the core particles, thereby forming a polymer layer (shell) on each surface of the core particles. When a monomer capable of forming a polymer having a glass transition temperature (Tg) higher than the Tg of the polymer component forming the core particles is used as the polymerizable monomer for shell, the shelf stability of the resulting polymerized toner can be improved. It is also possible to lower the fixing temperature of the resulting polymerized toner and enhance the uniformly melting ability thereof by presetting the Tg of the polymer component forming the core particles low, thereby meeting requirements such as the speeding-up of copying and printing, the formation of full-color images, and permeability through OHP (overhead projector) with good results. As the polymerizable monomer for shell, monomers capable of forming a polymer having a Tg of higher than 80° C., such as styrene and methyl methacrylate, are generally used either singly or in combination of two or more monomers thereof. A difference in Tg between the polymer component forming the core particles and the polymer composed of the polymerizable monomer for shell is generally at least 10° C., preferably at least 20° C., more preferably at least 30° C.

In the polymerized toner of the core-shell structure, the weight ratio of the polymerizable monomer for core to the polymerizable monomer for shell is generally 40/60 to 99.9/0.1, preferably 60/40 to 99.5/0.5, more preferably 80/20 to 99/1. If the proportion of the polymerizable monomer for shell is too low, the effect of improving the shelf stability becomes little. If the proportion is too high on the other hand, the effects of lowering the fixing temperature and improving the permeability through OHP become little.

3. Toner for Development of Electrostatic Image:

The toner for development of electrostatic image s according to the present invention has a volume average particle diameter (dv) of generally 0.5 to 20 $\mu$m, preferably 1 to 15 $\mu$m, more preferably 3 to 10 $\mu$m. The particle diameter distribution, i.e., a volume average particle diameter (dv) to a number average particle diameter (dp), of the polymerized toner is generally at most 2.0, preferably at most 1.7, more preferably at most 1.5, particularly preferably at most 1.4.

The polymerized toner according to the present invention may be used as a developer as it is. However, it is generally combined with external additives such as a flowability-imparting agent and an abrasive to provide a developer. When the external additives are added to and mixed with the polymerized toner, such external additives attach to the surface of the toner. The external additives bear an action that the flowability of the toner is enhanced, or that the formation of a toner film on a photosensitive member or the like is prevented by their abrading action.

Examples of the external additives include inorganic particles and organic resin particles. Examples of the inorganic particles include particles of silica (silicon dioxide), aluminum oxide, titanium oxide, zinc oxide, tin oxide, barium titanate, strontium titanate, etc. Examples of the organic resin particles include particles of methacrylic ester polymers, acrylic ester polymers, styrene-methacrylic ester copolymers and styrene-acrylic ester copolymers, and core-shell type particles in which the core is composed of a methacrylic ester polymer, and the shell is composed of a styrene polymer.

Among these, the particles of the inorganic oxides are preferred, and silica particles are more preferred, with the silica particles subjected to a hydrophobicity-imparting treatment being particularly preferred. In order to attach the external additives to the polymerized toner, in general, the external additives and the polymerized toner are charged into a mixer such as a Henschel mixer to mix them under stirring. No particular limitation is imposed on the amount of the external additives added. However, it is generally about 0.2 to 6 parts by weight per 100 parts by weight of the polymerized toner. Two or more of the external additives may be used in combination.

The toner for development of electrostatic images according to the present invention may be suitably used as a non-magnetic one-component developer, is excellent in stability to positive charging in a non-magnetic one-component development system, little in variation of charge level by changes in environments such as temperature and humidity or continuous printing, has excellent flowability and shelf stability, and can retain high image quality in monochromatic or color printing. The toner for development of electrostatic images obtained by using magnetic particles as a colorant may be used as a magnetic one-component developer. The toners for development of electrostatic images according to the present invention may also be used as two-component developers by using carrier particles in combination as needed.

EXAMPLES

The present invention will hereinafter be described more specifically by the following Examples and Comparative Examples. Al designations of "part" or "parts" and "%" as will be used in the following examples mean part or parts by weight and wt. % unless expressly noted.

Methods for evaluating physical properties and characteristics of toners will hereinafter be described.

(1) Weight Average Molecular Weight (Mw):

The weight average molecular weight of each quaternary ammonium salt group-containing copolymer sample was determined as a value in terms of polystyrene as measured by gel permeation chromatography (GPC) using tetrahydrofuran. Specifically, the following method is followed.

Preparation of Specimen:

After about 10 mg of a sample were dissolved in 5 ml of tetrahydrofuran and left to stand for 16 hours at 25° C., the solution was filtered through a membrane filter having a pore size of 0.45 μm to prepare a specimen.

Measuring Conditions:

Temperature: 35° C.

Solvent: tetrahydrofuran

Flow rate: 1.0 ml/min

Concentration: 0.2 wt. %

Amount of specimen poured: 100 μl

Column: Showdex GPC KF806M (30 cm×2 columns), product of Showa Denko K.K.

(2) Particle Diameter of Toner:

The volume average particle diameter (dv) of a polymerized toner sample was measured by means of a MULTISIZER (manufactured by Coulter Co.). The measurement by the MULTISIZER was conducted under the following conditions:

aperture diameter: 50 μm;

medium: Isothone II, concentration: 10%; and number of particles measured: 50,000 particles.

(3) Flowability:

Three kinds of sieves having sieve openings of 150 μm, 75 μm and 45 μm, respectively, are laid on top of another in that order from above, and a developer (4 g) to be measured was precisely weighed and put on the uppermost sieve. The three kinds of sieves are vibrated for 15 seconds by means of a powder measuring device ("REOSTAT", trade name; manufactured by Hosokawa Micron Corporation) under conditions of vibration intensity of 4. Thereafter, the weight of the developer remaining on each sieve was measured and substituted into its corresponding equation ①, ② or ③ shown below, thereby calculating out the respective numeric values of a, b and c. These values were then substituted into the following equation ④ to calculate out a flowability value. The measurement was conducted 3 times on one sample to find an average value thereof.

Equations for Calculating:

$$a=[\text{weight (g) of the developer remaining on the sieve of 150 } \mu\text{m}/4\text{ g}]\times 100 \quad ①$$

$$b=[\text{weight (g) of the developer remaining on the sieve of 75 } \mu\text{m}/4\text{ g}]\times 100\times 0.6 \quad ②$$

$$c=[\text{weight (g) of the developer remaining on the sieve of 45 } \mu\text{m}/4\text{ g}]\times 100\times 0.2 \quad ③$$

$$\text{Flowability (\%)}=100-(a+b+c) \quad ④$$

(4) Shelf Stability:

Each developer sample was placed in a closed vessel to seal it, and the vessel was sunk into a constant-temperature water bath controlled to 55° C. The vessel was taken out of the constant-temperature water bath after a predetermined period of time went on, and the developer contained in the vessel was transferred to a 42-mesh sieve. At this time, the developer was quietly taken out of the vessel so as not to destroy the aggregate structure of the developer in the vessel, and carefully transferred to the sieve. The sieve was vibrated for 30 seconds by means of a powder measuring device ("REOSTAT", trade name; manufactured by Hosokawa Micron Corporation) under conditions of vibration intensity of 4.5. The weight of the developer remaining on the sieve was then measured to regard it as the weight of the developer aggregated. A proportion (wt. %) by weight of the aggregated developer to the whole developer was calculated out. The measurement was conducted 3 times on one sample to use the average value thereof as an index to the shelf stability.

(5) Dependence of Charge Level on Environment:

After a developer sample was charged into a printer (4 papers per minute printer) of a non-magnetic one-component development system under respective environments of L/L (10° C. in temperature and 20% in relative humidity) and H/H (30° C. in temperature and 80% in relative humidity) and left to stand for 24 hours, a print pattern of half tone was printed 5 times, and the developer on a developing roll was then sucked in a suction type charge level meter to measure a charge level per unit weight from the charge level and weight of the toner sucked at this time. The conditions of the developer by changes in environment were evaluated from the variations of charge level under the respective environments.

(6) Dependence of Image Quality on Environment:

Printing was continuously conducted from the beginning by means of the above-described printer under respective environments of L/L (10° C. in temperature and 15% in relative humidity) and H/H (35° C. in temperature and 85% in relative humidity) to count the number of printed sheets that continuously retained an image density of 1.3 or higher as measured by a reflection densitometer (manufactured by McBeth Co.) and at an unprinted area, fog of 10% or lower as measured by a whiteness meter (manufactured by Nippon Denshoku K.K.), thereby evaluating a developer sample as to the dependence of image quality on environment in accordance with the following standard:

○: the number of the printed sheets that continuously retained the above-described image quality was 10,000 or more;

Δ: the number of the printed sheets that continuously retained the above-described image quality was not less than 5,000, but less than 10,000; and X: the number of the printed sheets that continuously retained the above-described image quality was less than 5,000.

(7) Durability of Image Quality:

Printing was continuously conducted from the beginning by means of the above-described printer under room-temperature environment (23° C. in temperature and 50% in relative humidity) to count the number of printed sheets that continuously retained an image density of 1.3 or higher as measured by a reflection densitometer (manufactured by McBeth Co.) and at an unprinted area, fog of 10% or lower as measured by a whiteness meter (manufactured by Nippon Denshoku K.K.), thereby evaluating the developer sample as to the durability of image quality in accordance with the following standard:

○: the number of the printed sheets that continuously retained the above-described image quality was 10,000 or more;

Δ: the number of the printed sheets that continuously retained the above-described image quality was not less than 5,000, but less than 10,000; and X: the number of the printed sheets that continuously retained the above-described image quality was less than 5,000.

Example 1

(1) Preparation of Parting Agent Dispersion:

Ninety parts of styrene and 10 parts of a parting agent (Fischer-Tropsch wax, "FT-100", trade name; product of Shell MDS Co.) were wet ground by means of a media type wet grinding machine to prepare a styrene monomer parting agent dispersion in which the parting agent had been uniformly dispersed. The volume average particle diameter of the parting agent in this dispersion was 3.3 μm in terms of $D_{50}$ and 7.1 μm in terms of $D_{90}$. The solids content in this dispersion was 10.2%.

(2) Preparation of Quaternary Ammonium Salt Group-containing Copolymer:

After a 3-liter flask was charged with 900 parts of toluene, 88 parts of styrene, 4 parts of butyl acrylate, 8 parts of dimethylaminoethylbenzyl methacrylate chloride and 2 parts of azobisdimethylvaleronitrile and reacted at 80° C. for 8 hours under stirring, the solvent was removed by distillation under reduced pressure to obtain a quaternary ammonium salt group-containing copolymer (Mw=30,000, quaternary ammonium salt group-containing monomer unit=8.0 wt. %).

(3) Preparation of Polymerizable Monomer Composition (liquid mixture):

Twenty parts of the parting agent dispersion (containing 2 parts of the parting agent and 18 parts of styrene) prepared above, 65 parts of styrene, 17 parts of n-butyl acrylate, 5 parts of a magenta pigment (Pigment Red 122), 1 part of the quaternary ammonium salt group-containing copolymer and 0.3 parts of divinylbenzene were stirred and mixed by an ordinary stirring apparatus and then uniformly dispersed by a media type dispersing machine, thereby obtaining a polymerizable monomer composition.

(4) Preparation of Dispersing Agent-containing Aqueous Dispersion Medium:

An aqueous solution with 5.8 parts of sodium hydroxide (alkali metal hydroxide) dissolved in 50 parts of ion-exchanged water was gradually added to an aqueous solution with 9.5 parts of magnesium chloride (water-soluble polyvalent metallic salt;) dissolved in 250 parts of ion-exchanged water under stirring to prepare a dispersion of magnesium hydroxide colloid (colloid of hardly water-soluble metal hydroxide). The particle diameter distribution of the colloid formed was measured by means of a particle diameter distribution measuring device SALD-2000J (manufactured by Shimadzu Corporation) and found to be 0.37 μm in terms of $D_{50}$ (50% cumulative value of number particle diameter distribution) and 0.81 μm in terms of $D_{90}$ (90% cumulative value of number particle diameter distribution).

(5) Suspension Polymerization:

The polymerizable monomer composition obtained above was poured into the colloidal dispersion of magnesium hydroxide obtained above, the mixture was stirred for several minutes by an ordinary stirrer until droplets of the polymerizable monomer composition became stable, and 4 parts of a polymerization initiator, t-butyl peroxy-2-ethylhexanoate (product of Nippon Oil & Fats Co., Ltd.) was then dissolved therein. The resultant mixture was stirred at 12,000 rpm under high shearing force by means of a TK type homomixer to form droplets of the polymerizable monomer composition. The thus-prepared aqueous dispersion containing droplets of the polymerizable monomer composition was charged into a reactor equipped with an agitating blade to initiate a polymerization reaction at 90° C. After the reaction was continuously conducted for 8 hours, the reaction was stopped to obtain an aqueous dispersion (pH=11) of polymer particles.

While stirring the above-obtained aqueous dispersion of the polymer particles, the pH of the aqueous dispersion was adjusted to about 5.5 with sulfuric acid to conduct acid washing (25° C., 10 minutes). Filtration and hydration were then conducted, and washing water was sprayed on the residue after the dehydration to conduct water washing. Thereafter, the thus-treated residue was dried for 2 days by a dryer (at 45° C.) to obtain polymer particles.

(6) Developer (Toner):

To 100 parts of the polymer particles obtained above, were added 1.2 parts of silica ("HVK 2150", trade name; product of WACKER CHEMIE CO.) subjected to a hydrophobicity-imparting treatment and having an average particle diameter of 8 nm, and they were mixed by means of a Henschel mixer to prepare a non-magnetic one-component developer (hereinafter referred to as "toner" merely). The volume average particle diameter of the polymer particles (polymerized toner) was 7.1 μm.

The evaluation of image revealed that in both environments of high temperature and high humidity (H/H), and low temperature and low humidity (L/L), extremely good images good in color tone, high in image density and free of fog were obtained. The results are shown in Table 1.

Comparative Example 1

A polymerized toner and a developer were obtained in the same manner as in Example 1 except that a dispersion obtained by dispersing 2 parts of AEROGEL #200 negatively charged in 300 parts of ion-exchanged water was used in place of the colloidal dispersion of magnesium hydroxide used in Examples 1. The results are shown in Table 1.

TABLE 1

| | Example 1 | Comp. Example 1 |
|---|---|---|
| Charge control resin: | | |
| Weight average molecular weight (Mw) | 30,000 | 30,000 |
| Proportion of functional group (wt. %) | 8.0 | 8.0 |
| Amount added (part by weight) | 1.0 | 1.0 |
| Pigment | Magenta | Magenta |
| Inorganic dispersing agent | Magnesium hydroxide | Aerogel #200 |
| Polymerized toner: | | |
| Volume average particle diameter (dv) (μm) | 7.1 | 7.4 |
| Properties of toner: | | |
| Flowability (%) | 87 | 68 |
| Shelf stability (%) | 3 | 12 |
| Charge level (μC/g) | | |
| (H/H) | 28 | 24 |
| (L/L) | 31 | 34 |
| Environmental dependence of image quality | | |
| (H/H) | ○ | Δ |
| (L/L) | ○ | X |
| Durability of image quality | ○ | X |

(Note)
(1) Charge control resin: styrene/butyl acrylate/dimethylaminoethylbenzyl methacrylate chloride terpolymer (quaternary ammonium salt group-containing copolymer).
(2) Proportion of functional group: weight proportion of the quaternary ammonium salt group-containing (meth)acrylate unit in the quaternary ammonium salt group-containing copolymer.
(3) Amount of charge control resin added: parts by weight of the quaternary ammonium salt group-containing copolymer per 100 parts by weight of the polymerizable monomer composition for forming the polymerized toner.

The same shall apply to the following Tables 2 to 4.

Example 2

After a 3-liter flask was charged with 900 parts of toluene, 88 parts of styrene, 4 parts of butyl acrylate, 8 parts of dimethylaminoethylbenzyl methacrylate chloride and 3 parts of azobisdimethylvaleronitrile and reacted at 85° C. for 8 hours under stirring, the solvent was removed by distillation under reduced pressure to obtain a quaternary ammonium salt group-containing copolymer (Mw=26,000, quaternary ammonium salt group-containing monomer unit=8.0 wt. %).

A polymerized toner and a developer were obtained in the same manner as in Example 1 except that the charge control resin in Example 1 was changed to the above-obtained quaternary ammonium salt group-containing copolymer (Mw=26,000, quaternary ammonium salt group-containing monomer unit=8.0 wt. %). The evaluation results are shown in Table 2.

Example 3

After a 3-liter flask was charged with 900 parts of toluene, 88 parts of styrene, 4 parts of butyl acrylate, 8 parts of dimethylaminoethylbenzyl methacrylate chloride and 1.5 parts of azobisdimethylvaleronitrile and reacted at 78° C. for 10 hours under stirring, the solvent was removed by distillation under reduced pressure to obtain a quaternary ammonium salt group-containing copolymer (Mw=38,000, quaternary ammonium salt group-containing monomer unit=8.0 wt. %).

A polymerized toner and a developer were obtained in the same manner as in Example 1 except that the charge control resin in Example 1 was changed to the above-obtained quaternary ammonium salt group-containing copolymer (Mw=38,000, quaternary ammonium salt group-containing monomer unit=8.0 wt. %). The evaluation results are shown in Table 2.

Comparative Example 2

After a 3-liter flask was charged with 900 parts of toluene, 88 parts of styrene, 4 parts of butyl acrylate, 8 parts of dimethylaminoethylbenzyl methacrylate chloride and 8 parts of azobisdimethylvaleronitrile and reacted at 78° C. for 10 hours under stirring, the solvent was removed by distillation under reduced pressure to obtain a quaternary ammonium salt group-containing copolymer (Mw=16,000, quaternary ammonium salt group-containing monomer unit=8.0 wt. %).

A polymerized toner and a developer were obtained in the same manner as in Example 1 except that the charge control resin in Example 1 was changed to the above-obtained quaternary ammonium salt group-containing copolymer (Mw=16,000, quaternary ammonium salt group-containing monomer unit=8.0 wt. %). The evaluation results are shown in Table 2.

When the charge control resin having a low weight average molecular weight (Mw) was used, the flowability and shelf stability of the resultant toner were deteriorated, and images formed from the toner had fog to a great extent under a high-temperature and high-humidity environment. In the durability test as well, fog increased as the number of printed sheets grew to cause inconveniences on images formed.

Comparative Example 3

After a 3-liter flask was charged with 900 parts of toluene, 88 parts of styrene, 4 parts of butyl acrylate, 8 parts of dimethylaminoethylbenzyl methacrylate chloride and 1.3 parts of azobisdimethylvaleronitrile and reacted at 78° C. for 10 hours under stirring, the solvent was removed by distillation under reduced pressure to obtain a quaternary ammonium salt group-containing copolymer (Mw=42,000, quaternary ammonium salt group-containing monomer unit=8.0 wt. %).

A polymerized toner and a developer were obtained in the same manner as in Example 1 except that the charge control resin in Example 1 was changed to the above-obtained quaternary ammonium salt group-containing copolymer (Mw=42,000, quaternary ammonium salt group-containing monomer unit=8.0 wt. %). The evaluation results are shown in Table 2.

When the charge control resin having a high weight average molecular weight (Mw) was used, the charge level of the resultant toner becomes low, and images formed from the toner had fog to a great extent under a high-temperature and high-humidity environment. In the durability test as well, fog increased as the number of printed sheets grew to cause inconveniences on images formed.

TABLE 2

| | Example | | Comp. Example | |
|---|---|---|---|---|
| | 2 | 3 | 2 | 3 |
| Charge control resin: | | | | |
| Weight average molecular weight (Mw) | 26,000 | 38,000 | 16,000 | 42,000 |
| Proportion of functional group (wt. %) | 8.0 | 8.0 | 8.0 | 8.0 |

TABLE 2-continued

| | Example | | Comp. Example | |
|---|---|---|---|---|
| | 2 | 3 | 2 | 3 |
| Amount added (part by weight) | 1.0 | 1.0 | 1.0 | 1.0 |
| Pigment | Magenta | Magenta | Magenta | Magenta |
| Polymerized toner: | | | | |
| Volume average particle diameter (dv) (μm) | 6.9 | 7.0 | 7.2 | 12.0 |
| Properties of toner: | | | | |
| Flowability (%) | 85 | 88 | 66 | 72 |
| Shelf stability (%) | 3 | 2 | 12 | 7.5 |
| Charge level (μC/g) | | | | |
| (H/H) | 28 | 30 | 31 | 12 |
| (L/L) | 31 | 32 | 34 | 18 |
| Environmental dependence of image quality | | | | |
| (H/H) | ○ | ○ | Δ | Δ |
| (L/L) | ○ | ○ | Δ | Δ |
| Durability of image quality | ○ | ○ | X | X |

Example 4

After a 3-liter flask was charged with 900 parts of toluene, 90 parts of styrene, 7 parts of butyl acrylate, 3 parts of dimethylaminoethylbenzyl methacrylate chloride and 2 parts of azobisdimethylvaleronitrile and reacted at 80° C. for 8 hours under stirring, the solvent was removed by distillation under reduced pressure to obtain a quaternary ammonium salt group-containing copolymer (Mw=31,000, quaternary ammonium salt group-containing monomer unit=3 wt. %).

A polymerized toner and a developer were obtained in the same manner as in Example 1 except that the charge control resin in Example 1 was changed to the above-obtained quaternary ammonium salt group-containing copolymer (Mw=31,000, quaternary ammonium salt group-containing monomer unit=3 wt. %), the amount of the charge control resin used was also changed from 1.0 part to 4.0 parts, and the magenta pigment (Pigment Red 122) was changed to a yellow benzimidazole pigment (Pigment Yellow 180). The evaluation results are shown in Table 3.

Example 5

After a 3-liter flask was charged with 900 parts of toluene, 84 parts of styrene, 3 parts of butyl acrylate, 13 parts of dimethylaminoethylbenzyl methacrylate chloride and 2 parts of azobisdimethylvaleronitrile and reacted at 80° C. for 8 hours under stirring, the solvent was removed by distillation under reduced pressure to obtain a quaternary ammonium salt group-containing copolymer (Mw=32,000, quaternary ammonium salt group-containing monomer unit=13 wt. %).

A polymerized toner and a developer were obtained in the same manner as in Example 4 except that the charge control resin in Example 4 was changed to the above-obtained quaternary ammonium salt group-containing copolymer (Mw=32,000, quaternary ammonium salt group-containing monomer unit=13 wt. %), and the amount of the charge control resin used was also changed from 4.0 parts to 1.0 part. The evaluation results are shown in Table 3.

Comparative Example 4

After a 3-liter flask was charged with 900 parts of toluene, 98 parts of styrene, 1.5 parts of butyl acrylate, 0.5 parts of dimethylaminoethylbenzyl methacrylate chloride and 2 parts of azobisdimethylvaleronitrile and reacted at 80° C. for 8 hours under stirring, the solvent was removed by distillation under reduced pressure to obtain a quaternary ammonium salt group-containing copolymer (Mw=30,000, quaternary ammonium salt group-containing monomer unit=0.5 wt. %).

A polymerized toner and a developer were obtained in the same manner as in Example 4 except that the charge control resin in Example 4 was changed to the above-obtained quaternary ammonium salt group-containing copolymer (Mw=30,000, quaternary ammonium salt group-containing monomer unit=0.5 wt. %). The evaluation results are shown in Table 3.

Comparative Example 5

After a 3-liter flask was charged with 900 parts of toluene, 80 parts of styrene, 4 parts of butyl acrylate, 16 parts of dimethylaminoethylbenzyl methacrylate chloride and 2 parts of azobisdimethylvaleronitrile and reacted at 80° C. for 8 hours under stirring, the solvent was removed by distillation under reduced pressure to obtain a quaternary ammonium salt group-containing copolymer (Mw=32,000, quaternary ammonium salt group-containing monomer unit=16 wt. %).

A polymerized toner and a developer were obtained in the same manner as in Example 5 except that the charge control resin in Example 5 was changed to the above-obtained quaternary ammonium salt group-containing copolymer (Mw=32,000, quaternary ammonium salt group-containing monomer unit=16 wt. %). The evaluation results are shown in Table 3.

TABLE 3

| | Example | | Comp. Example | |
|---|---|---|---|---|
| | 4 | 5 | 4 | 5 |
| Charge control resin: | | | | |
| Weight average molecular weight (Mw) | 31,000 | 32,000 | 30,000 | 32,000 |
| Proportion of functional group (wt. %) | 3.0 | 13.0 | 0.5 | 16.0 |
| Amount added (part by weight) | 4.0 | 1.0 | 4.0 | 1.0 |
| Pigment | Yellow | Yellow | Yellow | Yellow |
| Polymerized toner: | | | | |
| Volume average particle diameter (dv) (μm) | 7.1 | 7.0 | 6.8 | 7.1 |
| Properties of toner: | | | | |
| Fixing temperature (° C.) | 140 | 140 | 140 | 150 |
| Flowability (%) | 86 | 89 | 75 | 70 |
| Shelf stability (%) | 5 | 4 | 21 | 19 |
| Charge level (μC/g) | | | | |
| (H/H) | 26 | 29 | 19 | 38 |
| (L/L) | 29 | 32 | 22 | 30 |
| Environmental dependence of image quality | | | | |
| (H/H) | ○ | ○ | X | Δ |
| (L/L) | ○ | ○ | Δ | X |
| Durability of image quality | ○ | ○ | Δ | Δ |

Example 6

A quaternary ammonium salt group-containing copolymer (Mw=31,000, quaternary ammonium salt group-containing monomer unit=8.1 wt. %) was obtained in a similar manner to Example 1.

A polymerized toner and a developer were obtained in the same manner as in Example 1 except that the charge control resin in Example 1 was changed to the above-obtained quaternary ammonium salt group-containing copolymer (Mw=31,000, quaternary ammonium salt group-containing monomer unit=8.1 wt. %), the amount of the charge control resin used was also changed from 1.0 part to 0.3 parts, and the magenta pigment was changed to a cyan pigment (Pigment Blue 15:3). The evaluation results are shown in Table 4

Example 7

A quaternary ammonium salt group-containing copolymer (Mw=30,000, quaternary ammonium salt group-containing monomer unit=8.0 wt. %) was obtained in a similar manner to Example 1.

A polymerized toner and a developer were obtained in the same manner as in Example 6 except that the charge control resin in Example 6 was changed to the above-obtained quaternary ammonium salt group-containing copolymer (Mw=30,000, quaternary ammonium salt group-containing monomer unit=8.0 wt. %), and the amount of the charge control resin used was also changed from 0.3 parts to 3.0 parts. The evaluation results are shown in Table 4

TABLE 4

| | Example | |
|---|---|---|
| | 6 | 7 |
| Charge control resin: | | |
| Weight average molecular weight (Mw) | 31,000 | 30,000 |
| Proportion of functional group (wt. %) | 8.1 | 8.0 |
| Amount added (part by weight) | 0.3 | 3.0 |
| Pigment | Cyan | Cyan |
| Polymerized toner: | | |
| Volume average particle diameter (dv) (μm) | 7.1 | 6.9 |
| Properties of toner: | | |
| Fixing temperature (° C.) | 140 | 150 |
| Flowability (%) | 88 | 80 |
| Shelf stability (%) | 2 | 5 |
| Charge level (μC/g) | | |
| (H/H) | 26 | 41 |
| (L/L) | 29 | 38 |
| Environmental dependence of image quality | | |
| (H/H) | ○ | ○ |
| (L/L) | ○ | ○ |
| Durability of image quality | ○ | ○ |

INDUSTRIAL APPLICABILITY

According to the present invention, there are provided toners for development of electrostatic images, which are excellent in stability to positive charging, environmental stability of charge level, flowability and shelf stability and moreover little in variation of charge level by changes in environments such as temperature and humidity or continuous printing, and can retain high image quality in monochromatic or color images. The toners for development of electrostatic images according to the present invention undergo little changes in charge level in both environments of low temperature and low humidity, and high temperature and high humidity, and so the image quality of images formed therefrom is scarcely lowered. The toners for development of electrostatic images exhibit far excellent properties as color toners in particular.

Accordingly, the toners for development of electrostatic images can be suitably used in copying machines, printers, full-color copying machines of a non-magnetic one-component development system, etc.

What is claimed is:

1. A toner for development of electrostatic images, obtained by subjecting a polymerizable monomer composition containing at least a colorant, a polymerizable monomer and a charge control agent to suspension polymerization in an aqueous medium containing a dispersing agent, wherein (a) the dispersing agent is a cationic inorganic dispersing agent; and (b) the charge control agent is a quaternary ammonium salt group-containing copolymer comprising a vinyl aromatic hydrocarbon unit, a (meth)acrylate unit and a quaternary ammonium salt group-containing (meth) acrylate unit, having a weight average molecular weight of 26,000 to 40,000 in terms of polystyrene as measured by gel permeation chromatography using tetrahydrofuran and containing the quaternary ammonium salt group-containing (meth)acrylate unit in a proportion of 1 to 15 wt. %.

2. The toner for development of electrostatic images according to claim 1, wherein the quaternary ammonium salt group-containing copolymer is contained in a proportion of 0.1 to 5 parts by weight per 100 parts by weight of the polymerizable monomer.

3. The toner for development of electrostatic images according to claim 1, wherein a weight ratio of the vinyl aromatic hydrocarbon unit to the (meth)acrylate unit in the quaternary ammonium salt group-containing copolymer is 99:1 to 50:50.

4. The toner for development of electrostatic images according to claim 1, wherein the cationic inorganic dispersing agent is colloid of a hardly water-soluble metal hydroxide.

5. The toner for development of electrostatic images according to claim 1, wherein the colorant is another color colorant than a black colorant.

6. A process for producing a toner for development of electrostatic images by subjecting a polymerizable monomer composition containing at least a colorant, a polymerizable monomer and a charge control agent to suspension polymerization in an aqueous medium containing a dispersing agent, the process comprising (1) using, as the dispersing agent, a cationic inorganic dispersing agent; and (2) using, as the charge control agent, a quaternary ammonium salt group-containing copolymer comprising a vinyl aromatic hydrocarbon unit, a (meth)acrylate unit and a quaternary ammonium salt group-containing (meth)acrylate unit, having a weight average molecular weight of 26,000 to 40,000 in terms of polystyrene as measured by gel permeation chromatography using tetrahydrofuran and containing the quaternary ammonium salt group-containing (meth)acrylate unit in a proportion of 1 to 15 wt. %.

7. The production process according to claim 6, wherein a proportion of the quaternary ammonium salt group-containing copolymer contained is 0.1 to 5 parts by weight per 100 parts by weight of the polymerizable monomer.

8. The production process according to claim 6, wherein a weight ratio of the vinyl aromatic hydrocarbon unit to the (meth)acrylate unit in the quaternary ammonium salt group-containing copolymer is 99:1 to 50:50.

9. The production process according to claim 6, wherein the cationic inorganic dispersing agent is colloid of a hardly water-soluble metal hydroxide.

10. The production process according to claim 9, wherein the colloid of the hardly water-soluble metal hydroxide is dispersed in the aqueous medium as colloid particles having number particle diameter distributions, $D_{50}$ (50% cumulative value of number particle diameter distribution) of at most 0.5 $\mu$m and $D_{90}$ (90% cumulative value of number particle diameter distribution) of at most 1 $\mu$m.

11. The production process according to claim 6, wherein the colorant is another color colorant than a black colorant.

* * * * *